US005335583A

United States Patent [19]

Kaneko et al.

[11] Patent Number: 5,335,583

[45] Date of Patent: Aug. 9, 1994

[54] STOPPER MOUNTING STRUCTURE FOR USE ON RODLESS CYLINDER

[75] Inventors: Junya Kaneko; Hitoshi Yamamoto, both of Soka, Japan

[73] Assignee: SMC Corporation, Tokyo, Japan

[21] Appl. No.: 930,391

[22] PCT Filed: Jan. 16, 1991

[86] PCT No.: PCT/JP91/00036

§ 371 Date: Sep. 16, 1992

§ 102(e) Date: Sep. 16, 1992

[87] PCT Pub. No.: WO92/13199

PCT Pub. Date: Aug. 6, 1992

[51] Int. Cl.[5] ..... F01B 31/14

[52] U.S. Cl. ..... 92/13.5; 92/13.7; 92/13.8; 92/88; 411/263; 411/291

[58] Field of Search ..... 92/13.5, 13, 13.8, 13.7, 92/88; 411/263, 307, 291

[56] References Cited

U.S. PATENT DOCUMENTS 3,465,995 9/1969 Whitman .
4,838,146 6/1989 Stoll ..... 92/13.5
4,856,415 8/1989 Noda ..... 92/13

FOREIGN PATENT DOCUMENTS 393667 4/1924 Fed. Rep. of Germany ..... 411/307
63-190908 8/1988 Japan .
2-134405 5/1990 Japan .

*Primary Examiner*—Thomas E. Denion
*Attorney, Agent, or Firm*—Oblon, Spivak, McClelland, Maier & Neustadt

[57] ABSTRACT

In a rodless cylinder, a moving member which is moved along a cylinder body is reduced in height for the sake of compactness and stability. A stopper is mounted on a stopper support base, which is also reduced in height to preclude the possibilities of obstructing movement of the moving member, and includes a stopper lock mechanism with an adjusting screw suitable for use with the stopper support base of low height. More specifically, in a rodless cylinder having a stopper support base mounted on top of a cylinder body, the stopper support base is provided with inclined surfaces at the opposite ends thereof symmetrically in face to face relation with downwardly-facing inclined surfaces formed on opposite lateral side portions of the cylinder body, and firmly fastened to the cylinder body by setting bolts and clamp members having inclined surfaces face to face with the inclined surfaces. The stopper is threaded into the stopper support base on the cylinder body and is locked in position by threading the stopper into a lock plate and fastening the lock plate to the stopper support base by bolts.

3 Claims, 5 Drawing Sheets

STOPPER MOUNTING STRUCTURE FOR USE ON RODLESS CYLINDER

FIELD OF THE ART

This invention relates to a stopper mounting structure for use on a rodless cylinder for adjustment of the stroke range of a moving member which is movable along a stop surface of a cylinder body, and more particularly to a stopper mounting structure having features for fixation of a stopper support base on the cylinder body as well as a stopper lock mechanism.

BACKGROUND OF THE ART

As a result of the recent trends toward cutting the sizes of various machines and appliances into compact form, the rodless cylinders are required to be smaller in size and, for the sake of compactness and stability, to be smaller especially in terms of height of the moving member which is moved along a cylinder body.

On the other hand, for the purpose of adjusting the stroke range of the moving member or for the purpose of absorbing shocks of collision, a stopper support base of a rodless cylinder is fixed on the cylinder body, and a stopper which is equipped with a stopper bolt with a shock absorbing function is mounted on the stopper support base by means of a stroke adjusting screw. The stroke range is adjusted either by shifting the stopper forward or backward relative to the stopper support base or by shifting the position of the stopper support base itself along the cylinder body.

However, the above-described stopper needs to be locked in position by a lock nut in such a way as to maintain a predetermined degree of protrusion from the stopper support base. In this regard, as shown in FIGS. 7 and 8, the lock nut 3 is required to have an outer diameter B commensurate with the screw diameter of the stopper 2. Therefore, in an attempt to cope with a reduction in size of the moving member 5 which is reciprocated on and along the cylinder body 5, if the height of the stopper support base 1 is minimized to a level lower than the moving member 5 to preclude its collision against an object 6 on the moving member 5, the lock nut 3 will stand out higher than the stopper support base 1. This means that the lock nut 3 might become an obstacle to the reciprocating movement of the object 6 attached to the moving member 5, and its size is hinders to the efforts of downsizing rodless cylinders into a compact form.

Further, in order to fix the stopper support base at a desired position in the longitudinal direction of the cylinder body, it has been the conventional practice to grip part of opposite lateral side portions of the cylinder body 4 between the stopper support base 1 and a clamp member 7 as shown in FIG. 9, and to thread setting bolts 8 into the clamp member 7 through the stopper support base 1.

However, when clamped in position by the clamp member 7, the stopper support base 1 is subjected to a force which tends to warp its side portions as seen in the same figure, making it difficult to reduce the thickness of the stopper support base 1. Besides, a difficulty is also encountered in maintaining the clamp member 7 constantly in a predetermined posture. In some cases the stopper support base 1 is mounted on the cylinder body 4 in an inclined or tilted state as shown in FIG. 10.

SUMMARY OF THE INVENTION

In a rodless cylinder which is required to employ a stopper support base of a reduced height to cope with a reduction in height of the moving member which is moved along the cylinder body, it is a primary object of the present invention to provide a stopper mounting structure for adjustably mounting a stopper support base on the cylinder body in such a way as to permit a reduction of its thickness for the sake of compactness and obviating the necessity for imparting high strength to the stopper support base by precluding the possibilities of any large force being imposed on the stopper support base.

It is another object of the present invention to provide a stopper monting structure which can mount a stopper support base securely without inclination from an originally mounted position.

It is still another object of the present invention to provide a lock mechanism for the stroke adjusting screw, which can be mounted in position within a limited range of a stopper support base of a reduced height, for the sake of realizing a reduction in height of the moving member on the rodless cylinder.

In accordance with the present invention, there is provided, for achieving the above-stated objectives, a stopper mounting structure for a rodless cylinder having a cylinder body, a piston fitted in the cylinder body for reciprocating movement therein, a moving member to be put in reciprocating movement in synchronism with the piston, and a stopper support base having a stopper member for adjustment of the stroke range of the moving member and being mounted on top of the cylinder body, characterized in that the stopper mounting structure includes: a stopper support base formed in a height lower than the top side of the moving member on the cylinder body, and provided with inclined surfaces at the opposite ends thereof symmetrically in face to face relation with inclined surfaces at the opposite lateral sides of the cylinder body; and clamp members inserted between the inclined surfaces to fasten the stopper support base firmly to the cylinder body and provided with inclined surfaces in face to face relation with the above-mentioned inclined surfaces, respectively; the stopper support base being mounted on the cylinder body by means of setting bolts passed therethrough an threaded into the clamp members.

Further, in the above-described rodless cylinder according to the present invention, the stopper is threaded into the stopper support base on the cylinder body adjustably by means of an adjusting screw to adjust the stroke range of the moving member by a shift of its position into or out of the stopper support base, the adjusting screw being associated with a lock mechanism including a lock plate located on one side of the stopper support base away from the moving member and in threaded engagement with the stopper member, the lock plate being clamped to the stopper support base by bolts passed through bolt holes in the opposite end portions thereof and formed in a height equivalent to or lower than that of the stopper support base.

The lock plate is preferred to be formed with a thickness which is discordant with an integral multiple of the pitch of the screw thread of the above-mentioned adjusting screw.

In the rodless cylinder of the above-described arrangement, upon threading setting bolts into the clamp members through the stopper support base, the clamping forces of the bolts are imposed uniformly on opposite side portions of the stopper support base without exerting unduly large forces which would cause warping of the support base. Accordingly, it becomes possible to employ a stopper support base of reduced thickness for the sake of compactness. Besides, when mounting the stopper support base, the wedging action of paired symmetrical inclined surfaces contributes to fix the stopper support base firmly on the cylinder body without applying a large clamping torque to the setting bolts. Therefore, the stopper support base can be mounted on the cylinder body in an untilted state simply by tightening the setting bolts.

In addition, the stopper which is locked in position by the lock mechanism can be released from the clamping force which is applied thereto by the bolts through the lock plate, and the stopper adjusing screw can be moved forward or backward relative to the stopper support base to adjust the stroke range of the piston. After adjustment, the lock plate can be clamped to the stopper support base by the bolts again. In this instance, the lock plate, which can be formed in a smaller height as compared with a lock nut, permits a reduction of the height of the moving member, without creating problems, for the purpose of cutting down the size of the rodless cylinder.

BRIEF DESCRIPTION OF THE DRAWINGS

In the accompanying drawings.

BEST MODE FOR CARRYING OUT THE INVENTION

Figure 1:
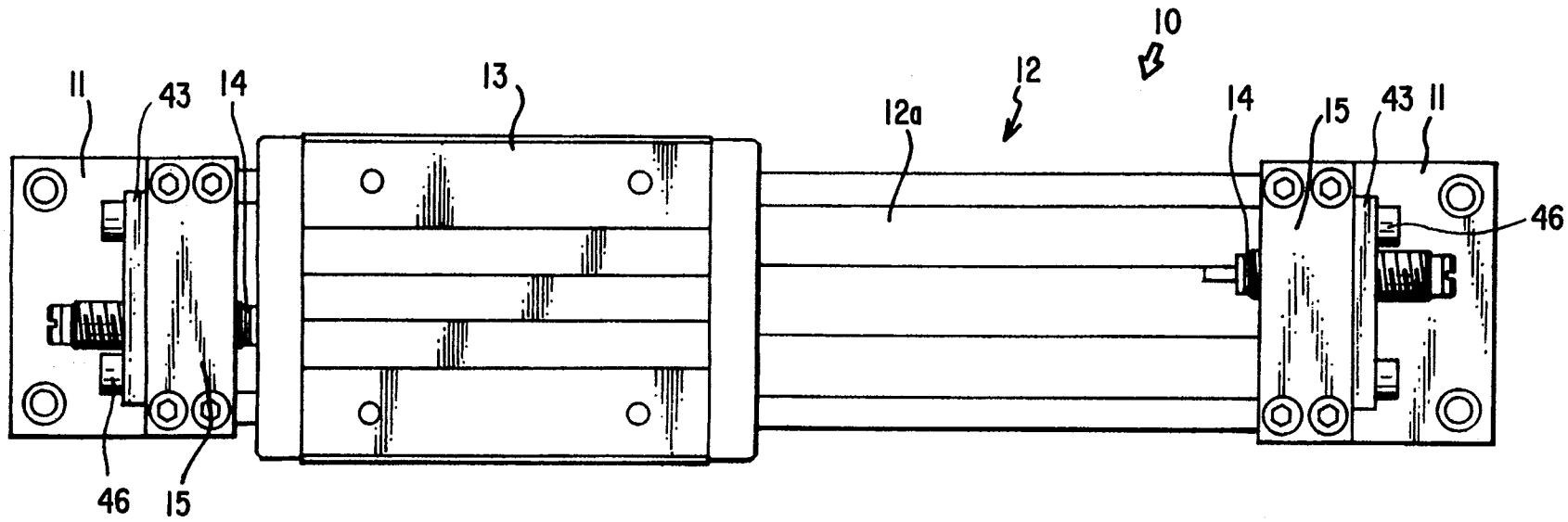
FIG. 1 is a plan view of a rodless cylinder embodying the present invention.
Figure 2:
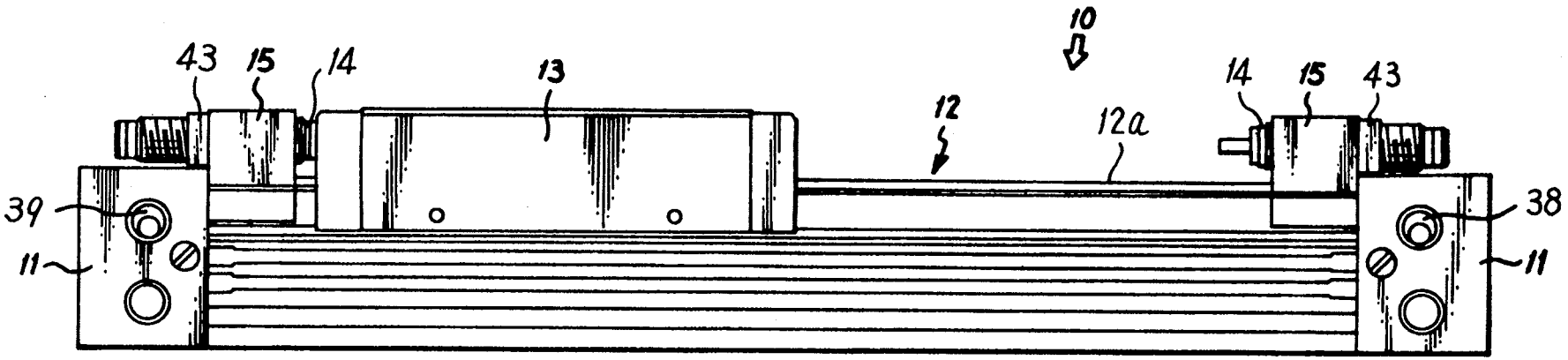
FIG. 2 is a side view of the same rodless cylinder.
Figure 3:
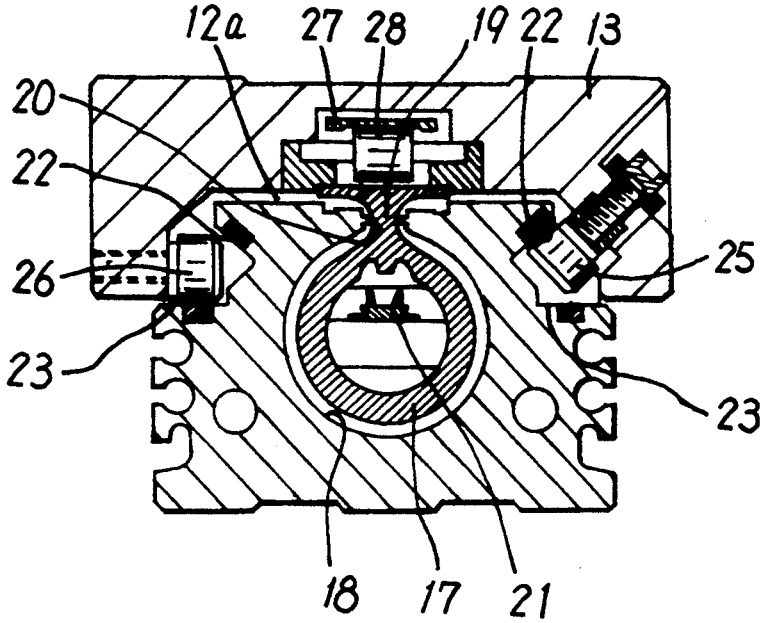
FIG. 3 is a vertical section of the cylinder.

Referring to FIG. 1 to 3, there is schematically shown a rodless cylinder including a cylinder body 12, end plates of which are attached to the opposite ends of the cylinder body 12, a moving member 13 which is movable in the longitudinal direction along a top surface 12*a* of the cylinder body 12, and a stopper support base 15 having a stopper 14 for adjusting the stroke range of the moving member 13.

The cylinder body 12 includes a cylinder bore 18 in which the piston 17 is reciprocated in the longitudinal direction, a slit 20 for receiving a radial link member 19 which interconnects the piston 17 and the moving member 13, a seal belt 21 which seals the slit 20 after passage of the link member 19, downwardly facing inclined runway surfaces 22 for rolling contact with rollers of the moving member 13, and upwardly facing horizontal runway surfaces 23 disposed opposingly to the inclined runway surfaces 22.

Further, the moving member 13 is provided with a plurality of rollers 25 and 26 which are rotatably supported at opposite lateral sides of the moving member 13 in rolling contact with the above-mentioned inclined runway surfaces 22 and horizontal runway surfaces 23, in addition to a guide roller 28 which is journalled internally of the moving member 13 in rolling contact with a dust seal 27 covering the top side of the slit 20.

Upon supplying compressed air to one pressure chamber on one side of the piston 17 in the cylinder body 12 of the above-described rodless cylinder, the moving member 13 is moved together with the piston 17, and the link member 19, which interconnects the piston 17 and the moving member 13, is moved therewith, pushing down the seal belt 21 to open the slit 20. After passage of the link member 19, the slit 20 is closed again by the seal belt 21. This basic construction of the rodless cylinder may employ various arrangements known in the art, for example, may be arranged in the so-called magnet drive type having a row of magnets mounted on both the piston and moving member so that they are moved in synchronism with each other by magnetic attraction.

Figure 4:
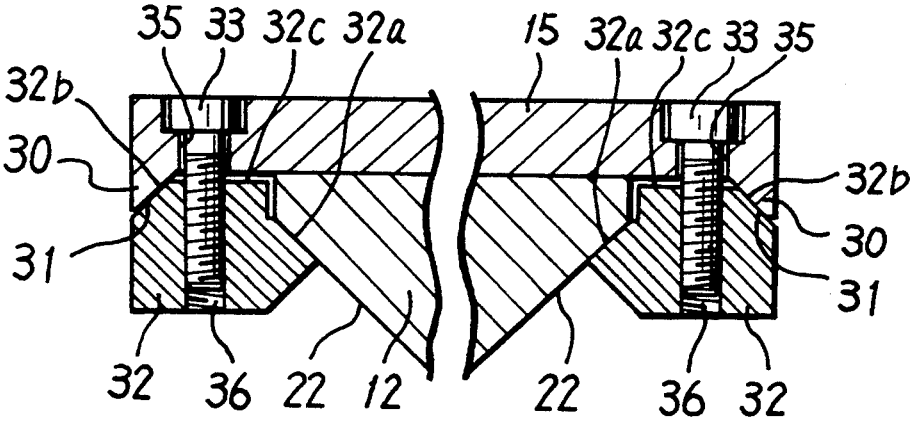
FIG. 4 is a vertical section of a stopper support base.
Figure 5:
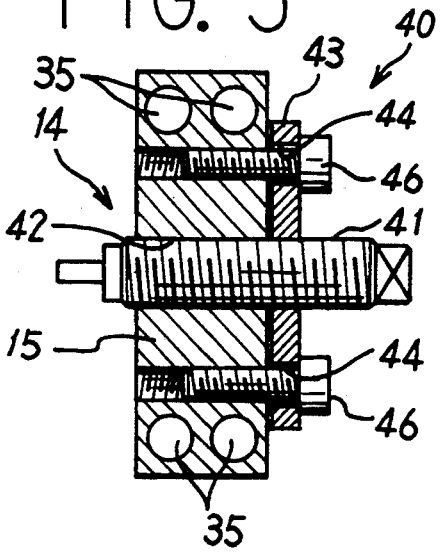
FIG. 5 is a transversely sectioned plan view of a stopper lock mechanism on the stopper support base.
Figure 6:
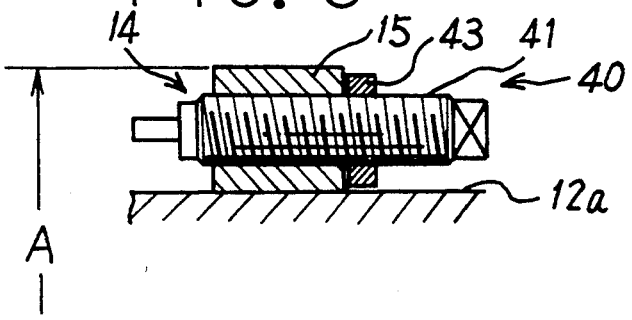
FIG. 6 is a vertical section of the stopper lock mechanism.
Figure 7:
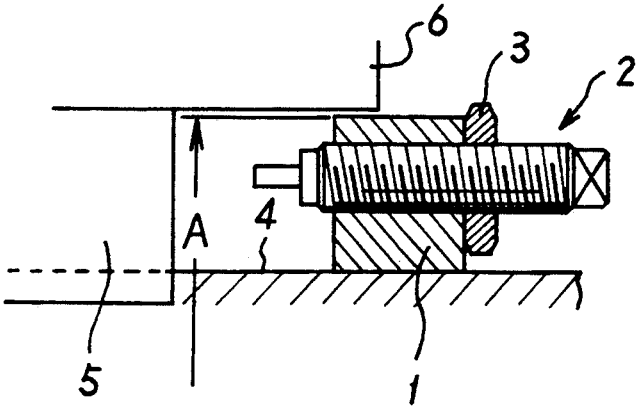
FIG. 7 is a vertically sectioned front view of a general stopper lock mechanism.
Figure 8:
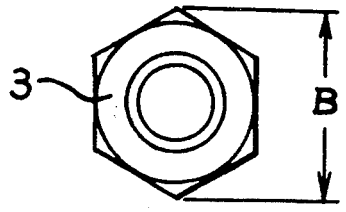
FIG. 8 is a front view of a lock nut.

As shown in FIG. 4, the stopper support base 15 is provided with ribs 30 on the lower side of its opposite ends in the tranverse direction of the cylinder body 12. The ribs 30 are provided with symmetrically inclined surfaces 31 in face to face relation with the down-facing runaway surfaces 22 on the cylinder body 12. On the other hand, inserted between the inclined surfaces 22 and 31 are clamp members 32 which hold the stopper support base 115 against the cylinder body 12. The clamp members 32 are formed with inclined surfaces 32*a* and 32*b* parallelly in face to face relation with the inclined surfaces 22 and 31 and in such a way that the top surface 32*c* of the clamp member 32 and the bottom surface of the stopper support base 15 are kept out of abutting engagement with each other when the inclined surfaces 32*a* and 32*b* are abutted on the inclined surfaces 22 and 31.

The stopper support base 15 is mounted on top of the cylinder body 12 across the width thereof, and a clamp member 32 is inserted between the cylinder body 12 and each one of the ribs 30. The stopper support base 15 is fixed firmly to the cylinder body 12 by means of bolts 33 which are threaded into female screw holes 35 in the clamp members 32 through bolt holes 35 in the stopper support base 15.

Figure 9:
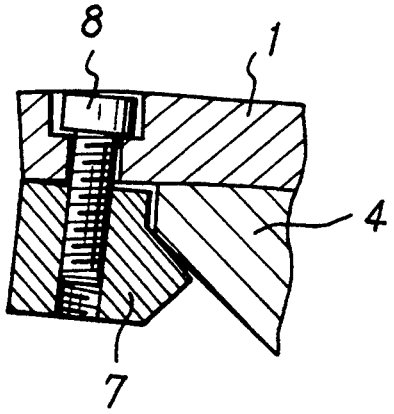
FIG. 9 is a partly cutaway view of the stopper support base in mounted state.

In this instance, the clamp members 32 are formed with the inclined surfaces 32*a* and 32*b* opposed to the symmetric inclined surfaces 22 and 31 on the cylinder body 12 and the rib 30, so that, when the setting bolts 33 are tightened into the clamp members 32, the clamping forces are exerted symmetrically relative to the axes of the setting bolts 33 without applying a force which would cause inclination of the clamp members by warping of the stopper support base 15 as shown in FIG. 9. By the wedge actions of the inclined surfaces, the stopper support base 15 is firmly fixed to the cylinder body 12. Besides, it becomes possible to employ a stopper support base 15 of relatively low strength, and as a result to make its height lower than the moving member 13. The bolt holes 35 need to have a room in the transverse direction of the cylinder body 12 to ensure uniform contact of the inclined surfaces.

Figure 10:
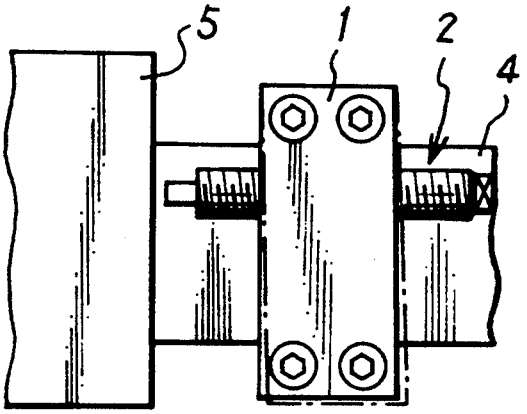
FIG. 10 is a schematic plan view of major components.

The symmetrical arrangement of the inclined surfaces 31 and the inclined runaway surfaces 22 suitably prevents inclinations of the stopper support base 15 on the cylinder body 12, which might otherwise occur as shown in FIG. 10.

With the above-described rodless cylinder, the moving member 13 is moved integrally with the piston 17 upon supplying compressed air to one of the pressure chambers on the opposite sides of the piston 17 through the port 38 or 39 which are opened in the end plates 11. The moving member 13 is stopped as soon as it comes into abutting engagement with the stopper 14 which is threaded on the stopper support base 15. The stroke range of the moving member 13 is adjusted by shifting the stopper 14 forward or backward relative to the stopper support base 15 or by fixing the stopper support bases themselves in suitable positions on the cylinder body 12.

Although the inclined runway surfaces 22 which guide the movement of the moving member are also utilized as surfaces for mounting the stopper support base 15 in the above-described embodiment, inclined mounting surfaces for the stopper support base 15 may be provided separately, if desired.

The stopper 14, which is provided on the stopper support base 15 on the cylinder body 12 for adjustment of the stroke range of the moving member 13 along the top surface of the cylinder body 12, is constituted by a shock absorber, a stopper bolt or the like and threaded into the stopper support base 15 through the adjusting screw 41 in engagement with the female screw 42 in the stopper support base 15 for an adjustment in the forward or backward direction.

The stopper 14 is also in threaded engagement with a lock plate 43 which is located on the outer side of the stopper support base 15 away from the moving member 13. The lock plate 43 is clamped to the stopper support base 15 by means of cap bolts 46 of small diameter which are passed through holes 44 in the opposite end portions of the plate, thereby to form a lock mechanism 40 for the stopper 14.

As compared with a lock nut, the lock plate 43 which has higher feasibility of reductions in height can be arranged to have a height equivalent to or lower than the stopper support base 15. Accordingly, there is no possibility of the lock mechanism 40 becoming an obstacle to downsizing the rodless cylinder.

In this instance, in order to let the lock plate 43 produce locking forces for the adjusting screw 41 in the axial direction of the stopper 14 upon tightening the cap bolts 46, there should be provided a gap of a certain width between the stopper support base 15 and the lock plate 43. However, normally a gap space is formed when the lock plate 43 is abutted against the stopper support base 15, due to a discontinuity which usually exists between the meeting ends of the screw threads of the stopper support base 15 and the lock plate 43.

Nevertheless, in anticipation of a rare case where the ends of two screw threads happen to meet continuously, it is preferred to form the lock plate 43 with a thickness which is discordant with an integral multiple of the pitch of the screw thread. By so doing, even if the ends of the two screw threads should happen to meet continuously, a gap space can be invariably formed between the stopper support base 15 and the lock plate 43 by reversing the sides of the lock plate when threading the stopper 14 on. Accordingly, the adjusting screw 41 can be locked firmly in position upon tightening the cap bolts 46.

When released from the clamping action of the lock plate 43 through the cap bolts 46, the stopper 14 can be moved forward or backward relative to the stopper support base by turning the adjusting screw 41 to adjust the stroke range of the moving member 13.

After adjusting the position of the stopper 14, it can be locked in that position by the clamping force of the lock plate 43 acting in the axial direction of the stopper 14, as soon as the lock plate 43 is clamped to the stopper support base 15 through the cap bolts 46.

In order to adjust the position of the stopper 14 over a larger distance, the stopper support 15 is shifted along the cylinder body 12 after releasing the clamp members 32 from the clamping action of the setting bolts 33, and then the setting bolts 33 are tightened again.

What is claimed is:

1. A stopper mounting structure for a rodless cylinder which comprises:

a cylinder body, a piston fitted in the cylinder body for reciprocating movement thereon, a moving member for reciprocatingly moving in synchronism with said piston, a stopper support base having a stopper member for adjustment of a stroke range of said moving member and mounted on top of said cylinder body, said cylinder body having downwardly facing runway surfaces on both outer sides of the cylinder body wherein said stopper support base has a height which is less than that of the top side of said moving member on said cylinder body, and is provided with inclined surfaces on opposite outer sides of the cylinder body symmetrically and facing toward said inclined surfaces of said cylinder body; and clamp members are positioned between said inclined surfaces for holding said stopper support base firmly to said cylinder body and are provided with inclined surfaces in parallelly facing said inclined surfaces of said cylinder body respectively;

said stopper support base being mounted on said cylinder body by setting bolts which are passed therethrough and threaded into said clamp members.

2. The stopper mounting structure as defined in claim 1, wherein said stopper is adjustably threaded into said stopper support base on said cylinder body by an adjusting screw to adjust the stroke range of said moving member by a shift of position into or out of said stopper support base, said adjusting screw including a lock mechanism having a lock plate located on one side of said stopper support base away from said moving member and in threaded engagement with said stopper member, the lock plate being clamped to the stopper support base by bolts passed through bolt holes formed in opposite end portions thereof and formed with a height equivalent to or less than that of said stopper support base.

3. The stopper mounting structure as defined in claim 2 wherein said lock plate has a thickness discordant with an integral multiple of the pitch of screw thread of said adjusting screw.

* * * * *